United States Patent [19]

Kakesu et al.

[11] Patent Number: 4,825,122

[45] Date of Patent: Apr. 25, 1989

[54] COLOR PICTURE TUBE OF IN-LINE GUN TYPE OPERABLE AT HIGH HORIZONTAL SCANNING FREQUENCY

[75] Inventors: Takateru Kakesu, Chiba; Hideo Oomori, Koganei, both of Japan

[73] Assignees: Hitachi Ltd.; Hitachi Device Engineering Co., Ltd., both of Tokyo, Japan

[21] Appl. No.: 179,302

[22] Filed: Apr. 8, 1988

[30] Foreign Application Priority Data

Apr. 10, 1987 [JP] Japan ..... 62-86888

[51] Int. Cl.[4] ..... H01J 29/02

[52] U.S. Cl. ..... 313/417; 313/456

[58] Field of Search ..... 313/409, 412, 414, 417, 313/425, 432, 456, 482

[56] References Cited

U.S. PATENT DOCUMENTS 3,961,220 6/1976 Say ..... 313/417

FOREIGN PATENT DOCUMENTS 56-76145 6/1981 Japan .
60-86736 5/1985 Japan .
60-86737 5/1985 Japan .
61-179038 8/1986 Japan .

*Primary Examiner*—David K. Moore
*Assistant Examiner*—Sandra L. O'Shea
*Attorney, Agent, or Firm*—Antonelli, Terry & Wands

[57] ABSTRACT

A color picture tube having an in-line electron gun and using a high frequency magnetic field for the horizontal deflection of three electron beams is disclosed in which a conductive skirt member is bonded to a portion of the side wall of a shielding electrode to reduce the resistance of the portion so that three electron beams are equally affected by a magnetic field induced by an eddy current in the side wall of the shielding electrode, and further a leg portion is extended from the skirt member to keep the tip of the leg portion in electrical contact with the inner surface of an electron tube and to support the electron gun by the leg portion.

4 Claims, 4 Drawing Sheets

COLOR PICTURE TUBE OF IN-LINE GUN TYPE OPERABLE AT HIGH HORIZONTAL SCANNING FREQUENCY

BACKGROUND OF THE INVENTION

The present invention relates to a color picture tube which includes an in-line electron gun and is suited to be operated at a high horizontal scanning frequency or a plurality of horizontal scanning frequencies.

A high resolution color picture tube is larger in number of horizontal scanning lines than an ordinary picture tube for television broadcasting, and hence is five to seven times higher in horizontal scanning frequency than the ordinary picture tube. For example, a display tube used as a video data display terminal is operated at a horizontal scanning frequency of 31.5 or 64 KHz. In a color picture tube using such a relatively high horizontal scanning frequency, a special contrivance is required for the convergence of electron beams.

In a Japanese patent application JP-A-56-76,145 filed by Mitsubishi Electric Corporation on Nov. 26, 1979, it is disclosed that in order to eliminate the deviation of the raster of an outer electron beam from the raster of a central electron beam, a magnetic field limiting element is provided, and further flanges acting as an eddy current inducing element are projected from above and below through holes for transmitting outer electron beams so as to be perpendicular to a magnetic field for the horizontal deflection of electron beams (hereinafter referred to as "horizontal deflection magnetic field").

Further, in Japanese patent application No. JP-A-60-86,736 and JP-A-60-86,737 filed by Nippon Electric Co., Ltd. on Oct. 17, 1983, it is proposed that a portion of the shielding wall of a shielding electrode is cut away, or that portion of the shielding wall of a shielding electrode which intersects a deflection magnetic field, is made small in area.

Furthermore, in a Japanese patent application JP-A-61-179,038 filed by Toshiba Corporation on Feb. 4, 1985, it is proposed that the thickness of the shielding wall of a shielding electrode is locally varied.

In a case where a color picture tube is operated at a relatively high horizontal scanning frequency, there arises the following problem. That is, that portion of the deflection magnetic field generated by a deflection yoke which exists on the cathode side, passes through the shielding wall of a shielding electrode, and thus an eddy current is induced in the conductive shielding wall by the deflection magnetic field which varies with time. Hence, the deflection magnetic field is weakened by a magnetic field generated by the eddy current. The magnetic field generated by the eddy current is perpendicular to the shielding wall, and hence affects to a central electron beam more than to outer electron beams. Thus, the distribution of horizontal deflection magnetic field is made non-uniform, and hence the convergence of electron beams cannot be realized. It is to be noted that the magnitude of eddy current is proportional to a deflection frequency.

At a horizontal scanning frequency used in a standard broadcasting system, the effect of the eddy current on the deflection magnetic field is very small, and hence the deviation of the raster of an outer electron beam from the raster of a central electron beam is so small as to produce no problem. While, a high resolution picture tube uses a large number of horizontal scanning lines, and is far higher in horizontal scanning frequency than an ordinary picture tube for television broadcasting. Accordingly, the high resolution picture tube is far greater in eddy current induced in the shielding wall of shielding electrode than the ordinary picture tube. Thus, in the high resolution picture tube, the convergence of electron beams is greatly affected by the eddy current.

According to the prior art mentioned in the above-referred Japanese patent applications, the deviation of the raster of an outer electron beam from the raster of a central electron beam can be eliminated, but there arise problems such as an increase in the number of parts used and an increase in the number of fabricating steps. Further, in a case where a portion of the shielding wall of a shielding electrode is cut away, the electrostatic shielding effect of the shielding electrode is weakened, and moreover the capability of the shielding electrode in protecting through holes for transmitting electron beams against a foreign substance peeling from the inner wall of a bulb such as carbon powder, is lowered. Furthermore, in a case where the thickness of the shielding wall of a shielding electrode is locally varied, the number of fabricating steps for forming the shielding electrode is increased.

SUMMARY OF THE INVENTION

It is an object of the present invention to provide a color picture tube which can be operated at a high horizontal scanning frequency without producing the deviation of the raster of an outer electron beam from the raster of a central electron beam, and which is made up of easily fabricated parts and can be readily constructed.

In order to attain the above object, a color picture tube according to the present invention has the following characteristic structure. An eddy current is induced in the side wall of a shielding electrode by a high-frequency magnetic field for the horizontal deflection of electron beams, and a magnetic field generated by the eddy current is strong in the vicinity of a central electron beam and is weak in the vicinity of each of two outer electron beams. In order to generate the magnetic field due to the eddy current equally for the central and outer electron beams, the distribution of the eddy current in the side wall of the shielding wall is made non-uniform, that is, those portions of the side wall which generate a magnetic field acting on the outer electron beams, are made smaller in electric resistance than the remaining portion of the side wall, to make the eddy current in the above portions larger than that in the remaining portion. In more detail, that portion of the side wall of the shielding electrode which generates a magnetic field acting on an outer electron beam, is covered with a skirt member to reduce the electric resistance of the portion, and a portion of the skirt member is extended so as to form a leg portion. The tip of the leg portion is so shaped as to be able to come into contact with the inner wall of a bulb (namely, the picture tube), to use the leg portion as a supporting member for supporting an electron gun. As mentioned above, the skirt portion and the leg portion are formed as a united body. Thus, the number of parts included in the shielding electrode is decreased, and the fabricating process of the shielding electrode becomes simple.

DESCRIPTION OF THE PREFERRED EMBODIMENTS

Figure 1:
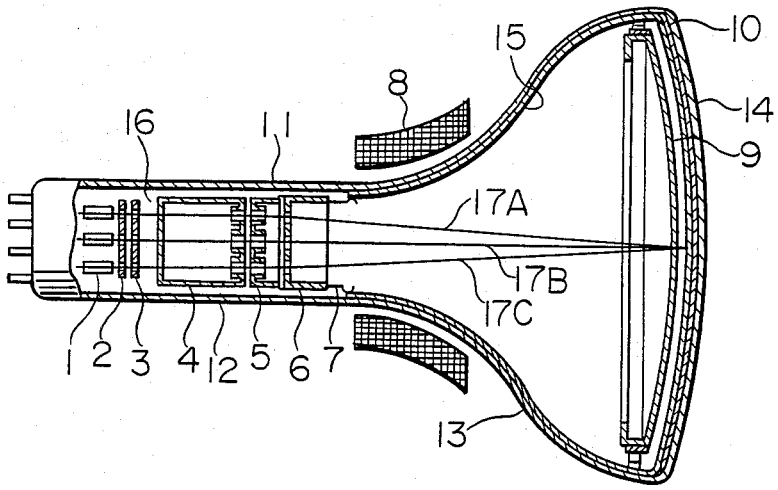
FIG. 1 is a sectional view showing a color picture tube of the in-line gun type, to which the present invention is applicable.

FIG. 1 is a sectional view showing a color picture tube, to which the present invention is applicable, and taken along a horizontal plane which contains the axis of the color picture tube. In FIG. 1, reference numeral 1 designates a cathode, 2 a first grid, 3 a second grid, 4 a third grid, 5 a fourth grid, 6 a shielding electrode, 7 a supporter (that is, a bulb spacer contact), 8 a deflection yoke, 9 a shadow mask assembly, 10 a fluorescent screen, 11 a bulb, 12 the neck portion of the bulb 11, 13 the funnel portion of the bulb 11, 14 the panel portion of the bulb 11, and 15 an inner conductive film (that is, a carbon film) formed on the inner surface of the funnel portion 13. The inner conductive film 15 is connected to a high-voltage terminal (not shown), to apply an anode voltage to the anode of an electron gun 16 through the bulb spacer contact 7. The bulb spacer contact 7 is moderately elastic, to fix the electron gun 16 surely to the inner wall of the neck portion 12, and is also used for applying the anode voltage to the anode. The bulb spacer contact 7 is usually provided at four places, and is indispensable for the electron gun. As mentioned above, the anode voltage is applied to the anode of the electron gun 16, and three electron beams 17A, 17B and 17C in the same plane are emitted from the electron gun 16, to bombard the fluorescent screen 10 through the shadow mask assembly 9.

Figure 2A:
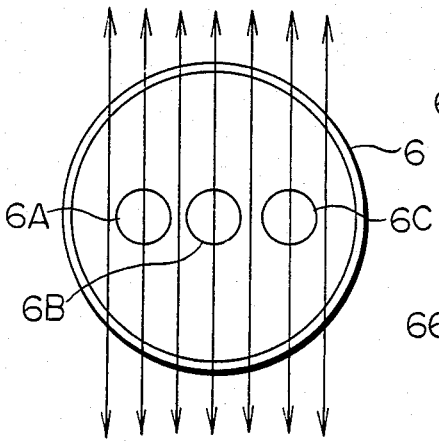
FIG. 2A is a schematic diagram showing the distribution of a horizontal deflection magnetic field in a shielding electrode.
Figure 2B:
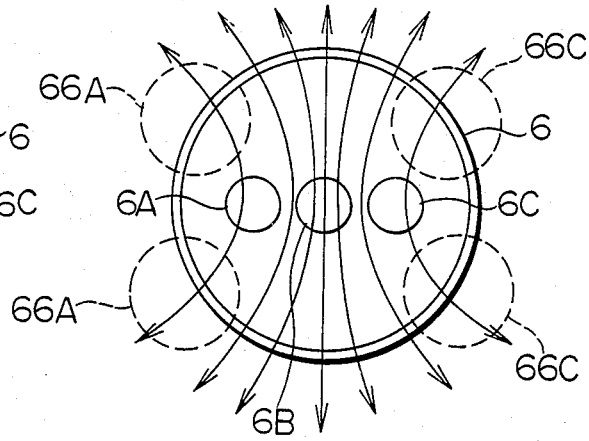
FIG. 2B is a schematic diagram showing the distribution of a magnetic field which is induced by an eddy current flowing in a shielding electrode.

FIGS. 2A and 2B are views of the shielding electrode 6 viewed from the fluorescent screen side. In FIGS. 2A and 2B, reference symbols 6A, 6B and 6C designate through holes for transmitting the electron beams. In FIG. 2A, the direction and distribution of a horizontal deflection magnetic field are indicated by lines with arrows. In FIG. 2B, the direction and distribution of a magnetic field induced by an eddy current which is generated in the side wall of the shielding electrode, are indicated by lines with arrows. As is apparent from FIGS. 2A and 2B, the horizontal deflection magnetic field is uniformly distributed in the shielding electrode, but the magnetic field due to the eddy current is strong in the vicinity of the through hole 6B for transmitting the central electron beam and is weak in the vicinity of each of the through holes 6A and 6C for transmitting the outer electron beams. When the magnetic field of FIG. 2A and the magnetic field of FIG. 2B are combined to form an actual horizontal deflection magnetic field, the actual magnetic field is non-uniformly distributed in the shielding electrode, and thus the convergence of the electron beams cannot be realized. Referring to FIG. 2B, a magnetic field acting mainly on the outer electron beams is induced by the eddy current in those portions of the side wall of the shielding electrode 6 which are bounded by each of dotted circles 66A and 66C. The magnetic field induced by an eddy current is perpendicular to the side wall of the shielding electrode 6. Hence, those portions of the side wall which are bounded by each of the circles 66A and 66C, can be geometrically determined. When the resistance of those portions of the side wall bounded by each of the circles 66A and 66C is reduced to increase the eddy current in the portions, the intensity of a magnetic field acting on the outer electron beams can be made equal to the intensity of a magnetic field acting on the central electron.

Figure 3A:
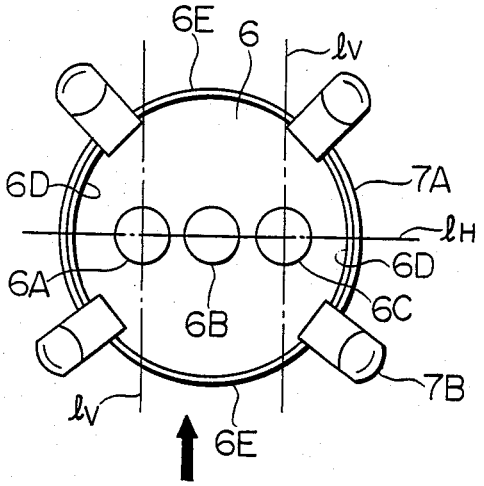
FIGS. 3A and 3B are views showing the structure of an embodiment of a shielding electrode according to the present invention.
Figure 3B:
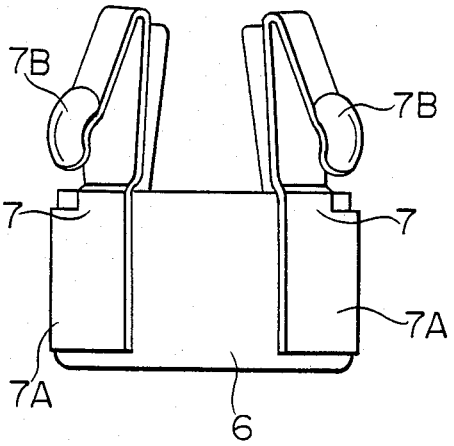

FIGS. 3A and 3B show the structure of an embodiment of a shielding electrode according to the present invention. In more detail, FIG. 3A shows the embodiment viewed from the fluorescent screen side, and FIG. 3B is that side view of the embodiment which is viewed in the direction as indicated with an arrow in FIG. 3A. Referring to FIGS. 3A and 3B, the bulb spacer contact 7 is made of a conductive material, and includes a contact portion (that is, a leg portion) 7B and a skirt portion 7A. The tip of the leg portion 7B is so shaped as to have a curved surface, to be suited for the electrical contact with the carbon film. Further, the leg portion 7B is bent at a central portion thereof, to have desired elasticity. Thus, the electron gun 16 can be accurately located in relation to the inner wall of the bulb 11 and fixed thereto by the leg portion 7B. The skirt portion 7A is disposed so that each of those portions of the shielding electrode which are bounded by the circle 66C or 66A, is covered by the skirt portion 7A, and is then fixed to the outer surface of the shielding electrode 6 by welding, to keep the skirt portion 7A in electrical contact with the shielding electrode.

Accordingly, that portion of the present embodiment where a wall portion 6D of the shielding electrode 6 and the skirt portion 7A of the bulb spacer contact 7 overlap each other, is smaller in electric resistance than a wall portion 6E of the shielding electrode 6, and thus is larger in eddy current induced by the horizontal deflection magnetic field than the wall portion 6E. Thus, the influence of the magnetic field due to an eddy current which is generated in the wall portion 6D and the skirt portion 7A, on the outer electron beams can be made equal to the influence of the magnetic field due to an eddy current which is generated in the wall portion 6E, on the central electron beam. In the present embodiment, the skirt portion 7A has substantially the same thickness as that of the side wall of the shielding electrode 6. However, it is preferred that the thickness and size (or area) of the skirt portion are experimentally determined so as to realize the convergence of three electron beams. Referring to FIG. 3A, a straight line $l_H$ passes through respective centers of three through holes 6A, 6B and 6C, and a straight line $l_V$ passes through the center of the through hole 6A or 6C and is perpendicular to the straight line $l_H$. It is preferred to coat that portion of the side wall of the shielding electrode which is interposed between the straight line $l_H$ and the straight line $l_V$, with the skirt portion 7A. In the present embodiment, the skirt portion 7A is fixed to the outer surface of the side wall, as shown in FIGS. 7A and 7B. Alternatively, the skirt portion 7A may be fixed to the inner surface of the side wall.

Figure 4A:
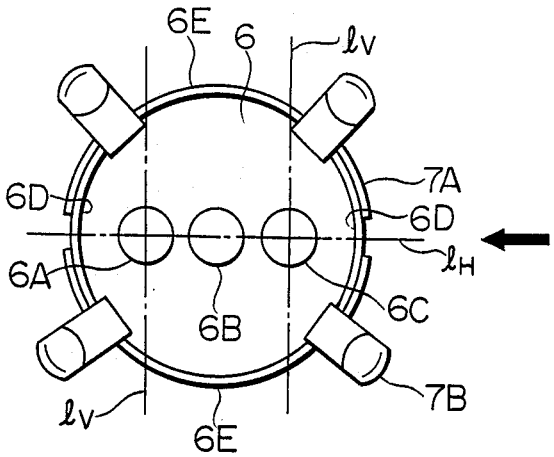
FIGS. 4A and 4B are views showing the structure of another embodiment of a shielding electrode according to the present invention.
Figure 4B:
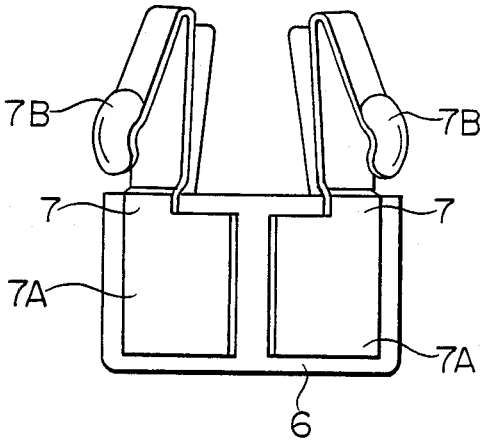

FIGS. 4A and 4B show another embodiment of a shielding electrode according to the present invention. In more detail, FIG. 4A shows the embodiment viewed from the fluorescent screen side, and FIG. 4B is that side view of the embodiment which is viewed in the direction as indicated with an arrow in FIG. 4A. In the embodiment of FIGS. 3A and 3B, two leg portions 7B are extended from one skirt portion 7A. While, in the present embodiment, four skirt portions 7A are fixed to the shielding electrode 6 and only one leg portion 7B is extended from one skirt portion 7A, as shown in FIGS. 4A and 4B. Each outer electron beam is scarcely affected by a magnetic field due to an eddy current generated in the vicinity of that portion of the side wall of the shielding electrode 6 where the straight line $l_H$ intersects the side wall, and hence the present embodiment can produce the same effect as obtained by the embodiment of FIGS. 3A and 3B.

Figure 5A:
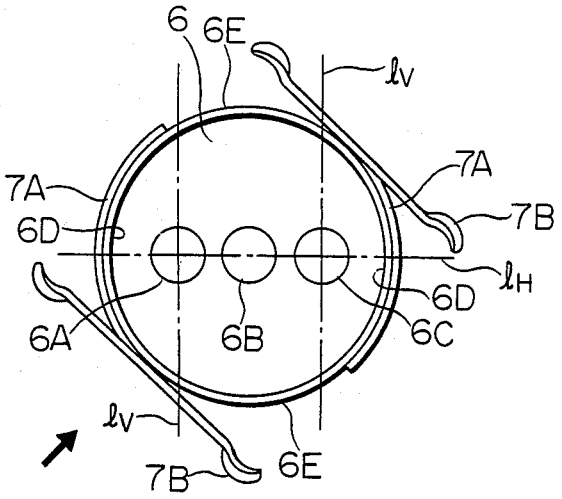
FIGS. 5A and 5B are views showing the structure of a further embodiment of a shielding electrode according to the present invention.
Figure 5B:
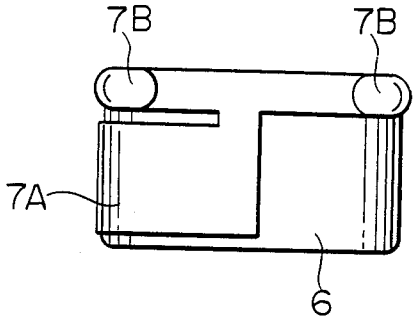

FIGS. 5A and 5B show a further embodiment of a shielding electrode according to the present invention. In more detail, FIG. 5A shows the embodiment viewed from the fluorescent screen side, and FIG. 5B is that side view of the embodiment which is viewed in the direction as indicated with an arrow in FIG. 5A. In the present embodiment, the leg portion 7B is extended in the direction of a tangent to the side wall of the shielding electrode 6. In this case, also, the skirt portion 7A and the leg portion 7B are united in one body.

As has been explained in the foregoing, according to the present invention, there is provided a color picture tube, in which a shielding electrode is made up of a small number of parts, and moreover can prevent the deviation of the raster of an outer electron beam from the raster of the central electron beam due to an eddy current in the shielding electrode.

We claim:

1. A color picture tube operable at a high horizontal scanning frequency, comprising:

an electron gun of the in-line type disposed in an electron tube for emitting three electron beams;

a shielding electrode disposed at the top of the electron gun and having the form of a cup for shielding the electron beams electrostatically from the outside, apertures for transmitting the electron beams being formed in the bottom of the cup so as to be in alignment; and supporting means made of a conductive material and kept in contact with the cup, the supporting means having a leg portion and a skirt portion, the leg portion and the skirt portion being united in one body, the tip of the leg portion being kept in contact with the inner surface of the electron tube, a portion of the side wall of the cup being covered by the skirt portion so that the central and outer ones of the electron beams are equally affected by a magnetic field induced by an eddy current in the shielding electrode.

2. A color picture tube according to claim 1, wherein a plurality of leg portions are extended from the skirt portion.

3. A color picture tube according to claim 1, wherein the skirt portion is mounted on the outer surface of the side wall of the cup.

4. A color picture tube according to claim 2, wherein the skirt portion is mounted on the outer surface of the side wall of the cup.

* * * * *